United States Patent [19]

Janoski et al.

[11] Patent Number: 4,561,969

[45] Date of Patent: Dec. 31, 1985

[54] METHOD FOR REMOVING CHLORINE COMPOUNDS FROM HYDROCARBON MIXTURES

[75] Inventors: Edward J. Janoski, Havertown, Pa.; Elmer J. Hollstein, Wilmington, Del.

[73] Assignee: The United States of America as represented by the United States Department of Energy, Washington, D.C.

[21] Appl. No.: 655,598

[22] Filed: Sep. 28, 1984

[51] Int. Cl.[4] ..... C10G 17/00

[52] U.S. Cl. ..... 208/262; 423/240; 423/241

[58] Field of Search ..... 208/262; 423/240, 241

[56] References Cited

U.S. PATENT DOCUMENTS

| | | | |
|---|---|---|---|
| 1,934,068 | 11/1933 | Jolly et al. | 208/262 |
| 2,267,458 | 12/1941 | Goldsby | 208/266 |
| 2,434,409 | 1/1948 | Iptieff et al. | 260/676 |
| 2,481,300 | 9/1949 | Engel | 208/262 |
| 2,558,011 | 6/1951 | Sprauer et al. | 423/241 |
| 3,246,977 | 4/1966 | Hinkle, Jr. | 423/240 R |
| 3,460,900 | 8/1969 | Moldovuin et al. | 423/240 R |
| 3,864,243 | 2/1975 | Reusser et al. | 208/262 |
| 3,919,399 | 11/1975 | Schabacher et al. | 423/240 R |
| 3,935,295 | 1/1976 | La Hue et al. | 208/262 |
| 4,003,723 | 1/1977 | Schofer et al. | 423/240 R |
| 4188,501 | 2/1980 | Rycheck et al. | 208/283 |
| 4,231,858 | 11/1980 | Seitzer et al. | 208/254 R |
| 4,338,186 | 7/1982 | Reif et al. | 208/254 R |

FOREIGN PATENT DOCUMENTS

| | | | |
|---|---|---|---|
| 0710600 | 1/1980 | U.S.S.R. | 423/240 |

OTHER PUBLICATIONS

U.S. DOE Contract No. DE-ACO1-78ET11041, "Refining to High Yields of Jet Fuel from Shale Oil", pp. 23-24.

*Primary Examiner*—John Doll
*Assistant Examiner*—Helane Myers
*Attorney, Agent, or Firm*—Hugh W. Glenn; Robert J. Fisher; Judson R. Hightower

[57] ABSTRACT

A process for removing halide ions from a hydrocarbon feedstream containing halogenated hydrocarbons wherein the contaminated feedstock is contacted with a solution of a suitable oxidizing acid containing a lanthanide oxide, the acid being present in a concentration of at least about 50 weight percent for a time sufficient to remove substantially all of the halide ion from the hydrocarbon feedstock.

10 Claims, No Drawings

METHOD FOR REMOVING CHLORINE COMPOUNDS FROM HYDROCARBON MIXTURES

CONTRACTUAL ORIGINAL OF THE INVENTION

The U.S. Government has rights in this invention pursuant to Contract No. DE-AC01-78ET-11041 between the U.S. Department of Energy and Sun Tech Inc., a subsidiary of Sun Company, Inc.

BACKGROUND OF THE INVENTION

This invention relates generally to the removal of halogens from halogenated hydrocarbons. Chloride compounds and other halogens cause numerous problems when associated with hydrocarbons used in various applications.

Chloride compounds have been recognized for some time as serious poisons to many catalytic reactions. Chlorides are extremely corrosive to processing equipment. Hydrocarbons products frequently contain small amounts of chlorine in the form of chemically combined chlorine. There are many ways in which small amounts of chemically combined chlorine can be introduced into a hydrocarbon product during the production or treatment thereof. Usually, however, chemically combined chlorine becomes a part of the hydrocarbon product during the reactions in which the hydrocarbons product is produced, because many chloride catalysts often introduce chlorine into the product which is not removable by water or caustic wash.

If chemically combined chlorine is not removed from hydrocarbon products, such as gasoline or other fuels, corrosion of engine parts can result, and the presence of chemically combined chlorine may also diminish the effect of tetraethyl lead or other additives when hydrocarbons products are used as fuels for internal combustion engines. Similarly, chemically combined chlorine in a solvent, such as an electrostatic toner solution, can cause interference in the end use of the solvent. Propane gas burned in homes has at times contained so much fluorine that when burned hydrogen fluoride was formed, severely etching the windows in the homes.

Additionally, there has been a recent increase in the use of shale oil. Raw retorted shale oil is unsuited for use as a refinery feedstock or as a finished fuel product because it contains excessive quantities of nitrogenous, compounds such as amines, amides, nitriles, pyrroles, indoles and carbazoles. One method for reducing these nitrogenous species in shale oil has been by hydrogenation of the weakly basic nitrogen compounds into stronger bases followed by anhydrous hydrogen chloride treatment to separate a non-miscible amine hydrochloride adduct. This treatment, however, leaves the resultant hydrocarbon stream contaminated with undesirable chloride ions.

For application to the above situations and others where halogen contamination of a hydrocarbon stream causes difficulties, it is necessary to have an inexpensive and efficient method for the removal of halogen ions from the hydrocarbon stream.

The present invention discloses a method by which chlorine and other halogens can be removed from the hydrocarbon product.

SUMMARY OF THE INVENTION

It is therefore an object of this invention to provide an effective, efficient and inexpensive method for the removal of the halogen moiety from halogenated hydrocarbons in hydrocarbon feedstocks.

This object is attained in accordance with the present invention by a process in which a hydrocarbon mixture either gaseous or liquid is digested with a saturated solution of cerium ions in concentrated sulfuric acid in water solution at temperature in the range of from about 0° C., to about 120° C. and at pressures of one atmosphere (atm) or higher.

Yet another object of the invention is to provide a process for removing halide ions from a hydrocarbon feedstream containing halogenated hydrocarbons comprising providing a hydrocarbon feedstock containing halogenated hydrocarbons, providing a solution of a suitable oxidizing acid containing a lanthanide salt, the acid being present in a concentration of at least about 50 weight percent, and contacting the feedstock containing hydrogenated hydrocarbons with the acid solution containing the lanthanide salt for a time sufficient to remove substantially all of the halide ion from the hydrocarbon feedstock.

Another object of this invention is to provide a process for removing chloride ions from a hydrocarbon feedstream containing chlorinated hydrocarbons comprising providing a hydrocarbon feedstock containing chlorinated hydrocarbons, providing a sulfuric acid solution substantially saturated with cerium ions, the sulfuric acid being present at a concentration of at least about 50 weight percent, the cerium ion being present at a concentration of about 0.5 weight percent, and passing the feedstock containing chlorinated hydrocarbons through the saturated sulfuric acid solution containing cerium ions for from about 1 to about 60 minutes at a temperature in the range of from about 40° to about 60° C. at a pressure of about one atmosphere or higher.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Example 1

A liquid hydrocarbon feedstream, a vacuum gas oil having a boiling range of 300° C. to 537° C. containing 580 parts per million weight of chlorine was combined with 0.5% $CeO_2$ by weight in 80% $H_2SO_4$ solution to make the concentrations of the ceria-sulfuric acid solution to be weight percent of the hydrocarbons feed stream. The cerium oxide in sulfuric acid solution was allowed to react with the hydrocarbons stream for a time of thirty minutes at a temperature of 40° to 60° C. at a pressure of one atmosphere. After this reaction took place, chlorine was present at below the detectable level of 50 ppm.

The hydrocarbon feedstock may be selected from any suitable source such as raw shale oil, saturate oils used in tranformers, ethane, propane, butane or gasoline for use in combustion engines. The example above describes the use of a carbonaeous liquid, but the process will work equally well with carbonaceous gases such as halogenated propane. The halogenated propane would be bubbled through sulfuric acid solution substantially saturated with cerium ions for a time dependent in part on the size of the bubbles. For use of the process with carbonaceous gases the temperature should also be elevated to about 60° C. to 100° C.

This process is applicable to halogen contamination at any concentration and is effective to remove halogen from contaminated feedstock to levels of less than 50 ppm. This process is effective to remove any of the halogens such as flourine, chlorine, bromine and iodine as well as combinations thereof. Tests have proved successful on flourine and chlorine contaminated hydrocarbons. Fluorine is the most difficult halogen to remove from hydrocarbons so it follows that the remaining halogens may be removed more easily using the same process.

In the preferred embodiment of the invention, a cerium salt such as an oxide or sulfate or mixtures thereof is used in conjunction with sulfuric acid. Sulfuric acid is used because it works well and is relatively inexpensive and easy to obtain, however, any oxidizing acid may be used. However, nitric acid has the disadvantage of oxidizing the hydrocarbons themselves and therefore may not be desirable.

It is believed that all lanthanides may be used in place of cerium. Lanthanum has been tested and was effective, although not as effective as cerium. Cerium is the least expensive and most readily available, and therefore, most desirable. Cerium's effectiveness can be explained from the fact that it has the greatest oxidation potential of the lanthanides. Because all lanthanide oxides are apparently interchangeable with the cerium oxides, the by-product fractions from molybdenium mining which contain high concentrations of salts including the oxides or sulfates of cerium and other lanthanides are suitable for use in the present invention. For instance, a bed of such ore or a processed product therefrom could be used to regenerate a sulfuric acid stream with oxides or sulfates of cerium and other lanthanides. It should be noted that both the ceric and cerous forms as applicable.

The optimal concentration of the $H_2SO_4$ is believed to be about 70 to 80% by weight. It is best to keep the concentrations of $H_2SO_4$ as low as possible while still attaining suitable halogen removal. Concentrated $H_2SO_4$ at 98% weight works very well but causes sulfonation, polymerizaton and excessive oxidation of the hydrocarbons. Polymerization and sulfonation are particularly high when aromatic hydrocarbons are present.

Stronger sulfuric acid can be used with hydrocarbon streams of high saturation. Concentrations of $H_2SO_4$, as low as 50% are acceptable, however, halogen removal is slower and not as complete.

The concentration of the oxides of cerium should be as close to saturated as possible. Cerium oxides are not very soluble so the 0.5 percent weight $CeO_2$ used in the present embodiment results in a substantially saturated solution depending on the temperature.

The mechanism for removing the halides from the hydrocarbons stream is not clear. It is believed that the cerium oxide breaks the chlorine ion from the hydrocarbon by way of an oxidation mechanism in the form of HCl. It is believed that the HCl combines with $H_2SO_4$ to form chlorosulfonic acid. The cerium may be regenerated to an oxide or sulfate of cerium by simply bubbling $O_2$ through the depleted $H_2SO_4$ solution.

The embodiments of the invention in which an exclusive property or privilege is claimed are defined as follows:

1. A process for removing halide ions from a hydrocarbon feedstream containing halogenated hydrocarbons comprising providing a hydrocarbon feedstock containing halogenated hydrocarbons, providing a solution of a suitable oxidizing acid containing a lanthanide salt, said oxidizing acid being present in a concentration of from about 50 weight percent to about 80 weight percent, said lanthanide salt being present in an amount sufficient to provide a substantially saturated solution of the oxidizing acid, and contacting the feedstock containing hydrogenated hydrocarbons with the acid solution containing the lanthanide salt for a time sufficient to remove substantially all of the halide ion from the hydrocarbon feedstock.

2. The process of claim 1, wherein the lanthanide salt is selected from the oxides or sulfates of lanthium, cerium and mixtures thereof.

3. The process of claim 2, wherein the cerium is present in acid solution as ceric or cerous or mixtures thereof.

4. The process of claim 1, wherein the lanthanide salt is an oxide.

5. The process of claim 1, wherein the acid is $H_2SO_4$ and the of acid is present at a concentration in the range of from about 70% by weight to about 80% by weight.

6. The process of claim 5, wherein the lanthanide is selected from the group consisting of $CeO_2$, $Ce_2O_3$, $Ce(SO_4)_2$, $Ce_2(SO_4)_3$ or mixtures thereof.

7. The process of clam 1, wherein the hydrocarbon is present as a gas.

8. The process of claim 1, wherein the hyrocarbon is present as a liquid.

9. A process for removing chloride ions from a hydrocarbon feedstream containing chlorinated hydrocarbons comprising providing a hydrocarbon feedstock containing chlorinated hydrocarbons providing a sulfuric acid solution substantially saturated with cerium ions, said sulfuric acid being present at a concentration of from about 50 weight percent to about 80 weight percent, and passing the feedstock containing chlorinated hydrocarbons through the substantially saturated sulfuric acid solution containing cerium ions for about 1 to about 60 minutes at a temperature in the range of from about 40° to 60° C. at a pressure of one atmosphere or higher.

10. The process of claim 8, wherein the cerium ion is present at a concentration equivalent to the addition of about 0.5 percent by weight of a cerium salt to the sulfuric acid solution.

* * * * *